US006328011B1

(12) United States Patent
Jessberger et al.

(10) Patent No.: US 6,328,011 B1
(45) Date of Patent: Dec. 11, 2001

(54) SUCTION PIPE FOR THE INTAKE AIR OF INTERNAL COMBUSTION ENGINES WITH PRESSURE-RELIEVING SITES FOR PRESSURE VALVES

(75) Inventors: Thomas Jessberger, Rutesheim; Kinh Toai Pham, Ludwigsburg; Herbert Pietrowski, Pleidelsheim, all of (DE)

(73) Assignee: Filterwek Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/580,113

(22) Filed: May 30, 2000

(30) Foreign Application Priority Data

May 29, 2000 (DE) ..... 199 24 870

(51) Int. Cl.[7] ..... F02M 35/12
(52) U.S. Cl. ..... 123/184.57
(58) Field of Search ..... 123/184.57, 184.21, 123/184.42, 184.53, 184.24, 184.34, 184.47; 181/214, 240

(56) References Cited

U.S. PATENT DOCUMENTS 5,572,966 * 11/1996 Doddy et al. ..... 123/184.57
5,771,851 * 6/1998 McLean ..... 123/184.57
5,806,480 * 9/1998 Maeda et al. ..... 123/184.57
6,155,224 * 12/2000 Akihisa et al. ..... 123/184.57

FOREIGN PATENT DOCUMENTS

2239048 * 6/1991 (GB) ..... 123/184.57

* cited by examiner

*Primary Examiner*—Willis R. Wolfe
*Assistant Examiner*—Hai Huynh
(74) *Attorney, Agent, or Firm*—Crowell & Moring LLP

(57) ABSTRACT

A suction pipe for the intake air of an internal combustion engine, which has a pressure relieving site in the form a bursting geometry 15 for backfiring impacts in the suction pipe. In the event of backfiring, the sites of weakness 17, 18, 24 fail and the bursting geometry is flung into the buffer volume 14, 14*a*, as a result of which the energy of the backfiring pressure wave is dissipated. As a result, further damage to the suction pipe is prevented, so that the emergency running properties of the internal combustion engine are retained. The proposed pressure-relieving sites have a high functional reliability, independently of the operating state of the internal combustion engine, particularly of the operating temperature.

21 Claims, 2 Drawing Sheets

SUCTION PIPE FOR THE INTAKE AIR OF INTERNAL COMBUSTION ENGINES WITH PRESSURE-RELIEVING SITES FOR PRESSURE VALVES

BACKGROUND OF THE INVENTION

The invention relates to a suction pipe for the intake air of internal combustion engines, which has a pressure-relieving site in the suction pipe for pressure waves coming from the cylinder.

Such pressure-relieving sites for suction pipes are generally known. The pressure-relieving sites are intended for the controlled dissipation of the energy contained in pressure waves due to so-called backfiring. Backfirings are flame reactions which, starting out from the cylinder-side inlets of the suction pipe, extend into the air-guiding ducts of the suction pipe. The danger that this phenomenon will occur exists particularly when the internal combustion engine is operating with a large timing overlap of the valves. The backfiring then consists of an already ignited portion of the fuel-air mixture in the cylinder. Backfiring can lead to destruction of the suction pipe structure, especially when plastic suction pipes are used. By these means, the functioning of the internal combustion engine is seriously endangered, since unfiltered supplementary air can be drawn in through the destroyed suction pipe. In this case, neither the supplying of the internal combustion engine with intake air of the required degree of purity nor the maintaining of limiting values with regard to the emission of pollutants by the internal combustion engine can be assured.

In order to eliminate this problem and thereby assure the emergency running properties of the internal combustion engine in the event of backfiring, a valve, for example, may be installed in the wall of the suction pipe. This comprises a rubber mushroom head, which assumes the function of a valve and is closed in the normal operating state of the internal combustion engine. In the event of backfiring, the pressure wave expands in the suction pipe and opens up the rubber mushroom head, which in this case functions as a pressure-relief valve. In this way, the overpressure in the surroundings of the internal combustion engine can be reduced, so that a component failure becomes less likely.

However, for reliable operation of the pressure-relieving site, an adequate cross section for the passage of the pressure wave is required. This cannot be provided by a rubber mushroom head valve, since the reliable operation of the valve cannot be assured when the dimensions of the component exceed a certain size. It would be possible to provide several valves. However, this represents an additional expense.

A further disadvantage of the pressure-relief valve has to do with flow properties. The geometry of the rubber mushroom head and of the associated outlet opening interferes with the internal contour of the suction pipe, as a result of which there is turbulence, which increases the flow losses of the intake air. Especially in the vicinity of the outlets of the suction pipe adjacent the cylinders, i.e. at the location where the backfiring originates, interference with the flow of the intake air is not acceptable, if a concerted production of turbulence in the combustion spaces of the cylinder is to be achieved. In other words, the rubber mushroom head must be mounted away from the location where the backfiring originates, as a result of which its effect is reduced.

A further disadvantage arises due to the use of a resilient or elastic material for producing a reasonably priced pressure-relief valve. The resilient or elastic properties are very dependent on the temperature, so that a constant functioning of the rubber mushroom head, independently of the operating temperature of the engine and of the external temperature, cannot be assured.

SUMMARY OF THE INVENTION

It is an object of the invention to provide a relief for pressure waves in a suction pipe, which ensures that the emergency running properties of the internal combustion engine function reliably and effectively.

This and other objects of the invention are achieved by the invention described and claimed hereinafter.

The inventive suction pipe, which enables the passage of intake air in a known manner, has a bursting geometry, which is accommodated in a wall section of the suction pipe, as a pressure-relieving site. This bursting geometry discharges into a buffer volume. In the event of backfiring and the destruction of the bursting geometry, the buffer volume is used for dissipating the energy of the pressure wave. The overall structure of the suction pipe therefore remains unchanged, the buffer volume representing a space, which is closed off to the outside, so that the total system represents a closed system even after the bursting geometry has been broken open. In this way, the emergency running properties of the internal combustion engine are maintained even if the incident becomes noticeable due to a changed gas exchange of the internal combustion engine. In any event, the vehicle with the damaged suction pipe can be moved under its own power to the next service station.

The bursting geometry can be an integral component of the walls of the suction pipe or it can be a separate part connected to the suction pipe. It is, for example, possible to construct the bursting geometry from a lid, which is glued into an associated opening in the wall of the suction pipe. The glued connection is then constructed as a predetermined breaking site, so that backfiring would cause the lid to be detached from the opening and flung into the buffer volume.

The buffer volume can be mounted at any place in the suction pipe. Particularly appropriate sites, however, are those which are close to the location where backfiring originates. The bursting geometry can then be built into the wall of the intake ducts leading to the cylinders. It is also possible to dispose the buffer volume in the collection space opposite the outlets from the collection space into the intake ducts of the suction pipe. A backfire spreading out is then conducted along the comparatively stable intake ducts and, in the collection space, strikes the bursting geometry, which is destroyed thereby.

If the wall section is formed by a glued-in lid, then it is advantageous to construct this, as well as the associated installed opening, in a conical shape, so that the lid can be inserted only from the side of the buffer volume. By these means, the blow-out direction of the lid into the buffer volume is clearly defined. If the lid is circular, it is furthermore ensured that, after it is blown out, it cannot leave the buffer volume and reach the suction pipe, where it could interfere with the passage of air.

In a further embodiment of the invention, the wall section is formed by a concerted weakening in relation to the wall surrounding it. It can then be produced in one piece with the suction pipe, for example, as a casting. The weakening of the wall then leads to a failure of the suction pipe at precisely this place in the event of backfiring. Advantageously, the weakening of the wall section is formed by a groove, which extends along a fracture edge of the bursting geometry. If the groove is ring-shaped, it forms a lid-like structure, which can be blown out by the backfiring.

In one embodiment of the invention, which is particularly advantageous from a flow point of view, the groove is on the side of the wall, remote from the interior of the suction pipe, that is, on the side of the buffer volume. The internal contour of the suction pipe can remain totally unaffected by the provision of the bursting geometry, so that the flow properties of the suction pipe are the same as those of a suction pipe without bursting geometry.

In order to ensure that the suction pipe functions reliably after the bursting geometry is destroyed, the wall section desirably may have a reinforced connecting region to the wall surrounding the suction pipe. Whereas the wall section along the fracture edge is pulled out of the suction pipe wall, the reinforced region remains in existence and can be constructed like a hinge. The wall section then remains hanging at this hinge and cannot pass to the suction pipe, where it would have an adverse effect on the flow in the suction pipe. In particular, when the groove is ring-shaped, the reinforced region can be produced by a change in the groove geometry. This change must be such that the wall thickness is greater in the reinforced region than in the region of the groove.

A particularly advantageous geometry of the wall section arises when the groove has an oval shape. The desired failure of the groove in the event of a bursting can be predicted very well with this geometry. As a result, the functional reliability of the bursting geometry is affected positively. A possible occurrence of stress peaks during the stressing of an angular lid is avoided. Of course, these advantages can also be achieved with a circular wall section, which in this sense is to be understood as a special case of the oval wall section.

In accordance with another embodiment of the invention, the wall section can also be provided with a buckling groove. This passes through the area of the wall section, as a result of which the wall section can be weakened selectively. The groove preferably proceeds along a straight line and from one edge of the wall section to the other. The effect of such a buckling groove can be compared with that of a hinge, as a result of which the detachment of the wall section in the event of bursting is supported. However, it is also possible to provide several buckling grooves, which can also cross one another. The bursting behavior of the wall section can thus be affected optimally, as a result of which a problem-free dissipation of the pressure wave into the buffer volume is assured.

In accordance with a modification of the invention, the buffer volume can, at the same time, fulfill a further task. This can be attained, for example, as a result of the fact that the buffer volume has openings to the interior of the suction pipe. In this way, the empty space can correspond with the interior of the suction pipe, as a result of which the intake noise is selectively dampened. This is done particularly with the idea of utilizing the buffer volume as a resonance chamber. Because of acoustic requirements that the suction pipe must meet, such resonance chambers frequently are present anyhow. In such cases, the utilization of this cavity as a buffer volume represents no additional manufacturing expense. Furthermore, no additional space is required for the internal combustion engine.

Another possibility is the utilization of the buffer volume as a reduced-pressure storage space, this being required for actuating other components of the engine. At the same time, the reduced pressure in the buffer volume increases the effect of the bursting geometry in the event of failure since, in relation to the pressure existing in the suction pipe, a greater portion of the backfire pressure wave can be absorbed.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be explained in further detail hereinafter with reference to an illustrative preferred embodiment shown in the accompanying drawings, in which.

DETAILED DESCRIPTION OF PREFERRED EMBODIMENTS

Figure 1:
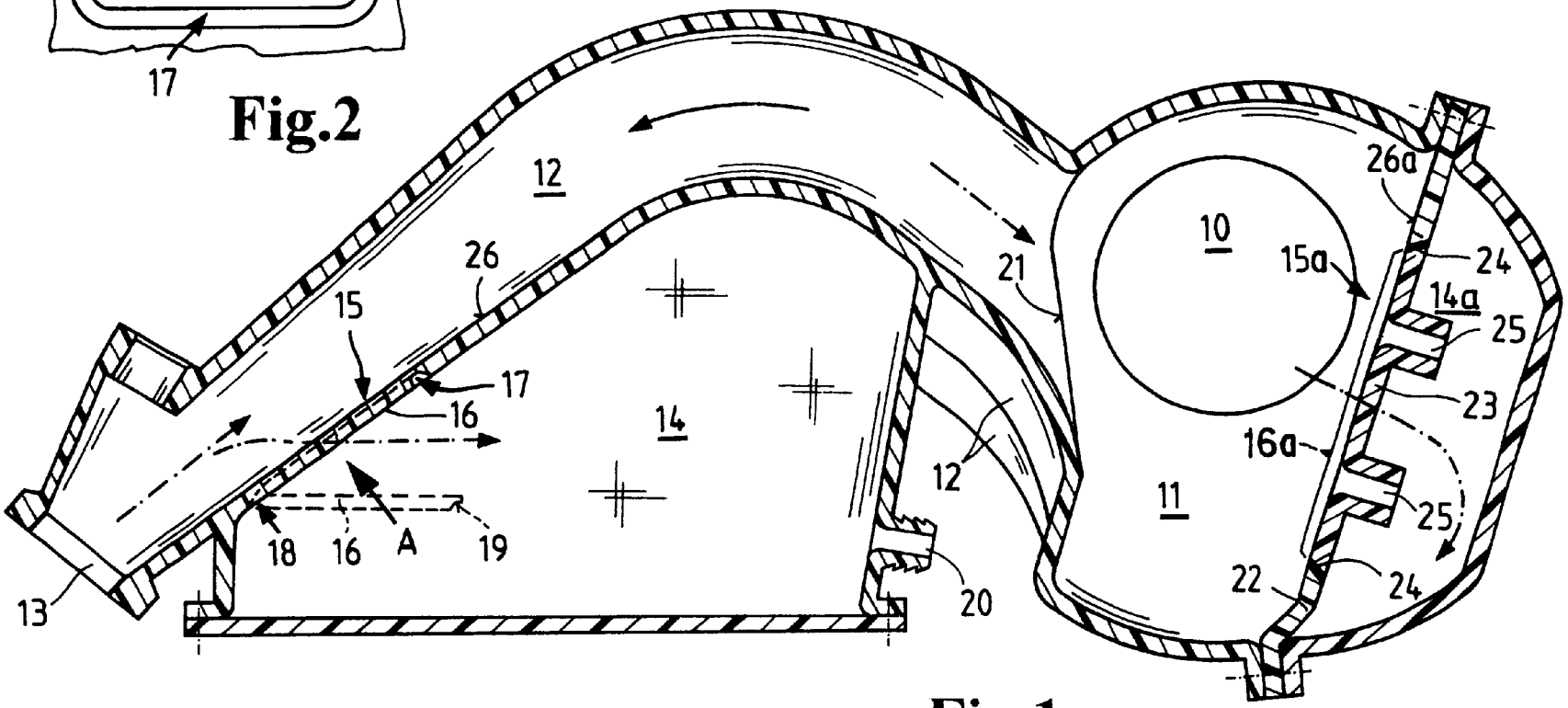
FIG. 1 shows a section through a suction pipe with a buffer volume along one of the intake ducts.

FIG. 1 shows the structure of a suction pipe with a buffer chamber or volume 14. The air enters through inlet 10 into a collection space 11, from where it is passed through the intake ducts 12 to cylindrical outlets 13, in order to pass through inlet valves, which are not shown. The direction of flow of the air in the normal operation of the internal combustion engine is indicated by a solid line arrow.

Figure 2:
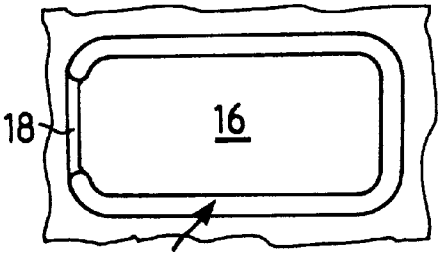
FIG. 2 shows the plan view of the bursting geometry corresponding to view A in FIG. 1.

The direction of the backfiring is indicated by broken line arrows. A buffer volume 14 is disposed adjacent to the intake ducts 12. The bursting geometry 15 is arranged in the common wall between the buffer volume 14 and the intake duct 12. The bursting geometry is comprised of a wall section 16, which is bounded by a groove 17 (see also FIG. 2). On the side of the wall section, which is constructed in the form of a rectangle, the groove tapers to a connection region 18, so that the wall thickness here is greater than in the region of the groove. In the event of a failure of the bursting geometry, the groove is torn open, a fracture edge 19 forming in the region of the groove and the wall section folding along the connecting region 18 into the buffer volume 14. By these means, the pressure wave of the backfire can expand in this cavity, as a result of which the remaining suction pipe remains undamaged.

The buffer volume 14 may simultaneously be used as a reduced-pressure (vacuum) storage space. For this purpose, a hose connection nipple 20 is disposed on the wall of the buffer volume 14. The reduced-pressure storage space is connected via the hose connection nipple 20 with a hose system, which is not shown, for actuating switching components of the engine, which are controlled by pressure.

A further buffer volume 14*a* is arranged adjacent the collection space 11 opposite the inlets 21 of the intake ducts 12. A partition 22 between the collection space 11 and the buffer volume 14*a* is provided with a conical lid 23, which forms the wall section 16*a* of the bursting geometry 15*a*. This lid is inserted over an adhesive joint 24 in the associated installation opening. The pressure wave of a backfire may lead to the failure of this adhesive joint. As a result, the lid 23 is flung into the buffer volume 14*a*.

The lid 23 furthermore is provided with openings 25, so that the buffer volume 14*a* simultaneously acts a resonance chamber during the normal operation of the internal combustion engine. The openings form the necks of a Helmholz resonator.

The wall sections 16 and 16*a* are fitted into the walls of the suction pipe in such a manner, that air-guiding geometries 26, 26*a* which are formed by the inner walls of the suction pipe, are not affected by flow impediments during the normal operation of the internal combustion engine. This is achieved as a result of the fact that the groove 17, as well as the connecting region 18, are accommodated in the wall on the side of the buffer volume 14 and the lid 23 is inserted into the conical installation opening in such a manner that the wall parts are flat along the adhesive joint 24.

Figure 3:
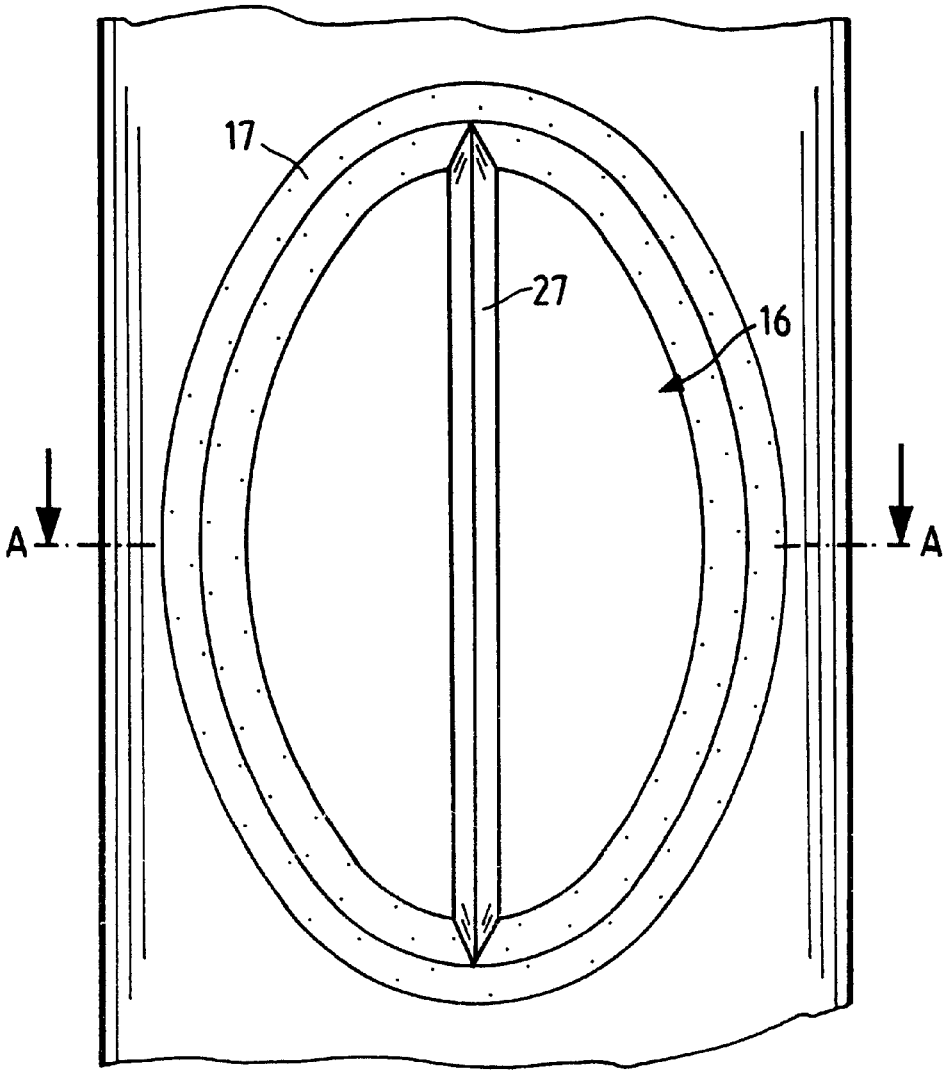
FIG. 3 shows the plan view of a bursting geometry with an oval groove.

FIG. 3 shows an example of a blow-out wall section 16 having an oval shape. Wall section 16 is surrounded by the groove 17, which has a constant V-shaped cross section. A buckling groove 27, which touches the groove 17 on opposite sides, extends along the long diameter of the oval.

Figure 4:
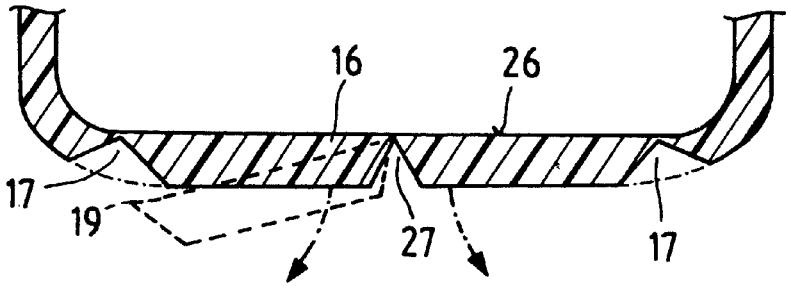
FIG. 4 shows a section taken along line A—A of FIG. 3.

The mode of action of the buckling groove 27 is illustrated in FIG. 4. In the event of bursting, the wall section is blasted out of the wall in the direction indicated by arrows. At the same time, the buckling groove 27 acts as a hinge, which leads to a collapse of the wall section. Moreover, the wall section 16 is severed in the groove 17 at least partially from the remaining suction pipe, so that a fracture edge 19 results, which is indicated by a burst state, shown by broken lines. The pressure wave can be dissipated by the opening that results. In this example also, the groove 17, as well as the buckling groove 27, are disposed on the side of the wall remote from the air-guiding geometry 26.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A suction pipe for intake air of an internal combustion engine, said suction pipe connecting an intake air inlet and at least one intake air outlet leading to a cylinder of the engine, said suction pipe having an interior surface defining an air-guiding geometry which connects said inlet and outlet with one another, said suction pipe further being provided with a pressure-relieving site for relieving pressure waves emanating from the outlet, said pressure-relieving site comprising a bursting geometry in a wall section of the suction pipe which can be burst open by the pressure waves, and a buffer volume adjoining said bursting geometry.

2. A suction pipe according to claim 1, wherein said bursting geometry comprises a lid installed in an associated opening in said wall section of the suction pipe.

3. A suction pipe according to claim 2, wherein said lid has a conical geometry which tapers toward the interior of the suction pipe.

4. A suction pipe according to claim 1, wherein said bursting geometry is formed by a weakening in said wall section relative to surrounding wall portions of the suction pipe.

5. A suction pipe according to claim 4, wherein said weakening is comprised of a groove which forms a fracture boundary around said wall section.

6. A suction pipe according to claim 5, wherein said groove is formed in said wall section on a side remote from the interior surface of the suction pipe which defines the air-guiding geometry.

7. A suction pipe according to claim 1, wherein said bursting geometry is defined by a groove which is formed in said wall section on a side remote from the interior surface of the suction pipe which defines the air-guiding geometry.

8. A suction pipe according to claim 1, said wall section has a rein forced connecting region to the surrounding wall of the suction pipe.

9. A suction pipe according to claim 1, wherein said wall section has an oval shape.

10. A suction pipe according to claim 1, wherein at least one buckling groove is provided on said wall section.

11. A suction pipe according to claim 1, wherein said buffer volume communicates through an opening with the interior of the suction pipe.

12. A suction pipe according to claim 11, wherein said buffer volume forms a Helmholz resonating chamber.

13. A suction pipe according to claim 1, wherein said buffer volume comprises a reduced-pressure storage chamber provided with at least one connecting nipple for a vacuum line.

14. A suction pipe according to claim 1, wherein the bursting geometry in the wall section of the suction pipe can be permanently burst open by the pressure waves.

15. A suction pipe for intake air of an internal combustion engine, said suction pipe connecting an intake air inlet and at least one intake air outlet leading to a cylinder of the engine, said suction pipe having an interior surface defining an air-guiding geometry which connects said inlet and outlet with one another, said suction pipe further being provided with a pressure-relieving site for relieving pressure waves emanating from the outlet, said pressure-relieving site comprising a bursting geometry in a wall section of the suction pipe, and a buffer volume adjoining said bursting geometry and located in the vicinity of the cylinder of the engine.

16. A suction pipe for intake air of an internal combustion engine, said suction pipe connecting an intake air inlet and at least one intake air outlet leading to a cylinder of the engine, said suction pipe having an interior surface defining an air-guiding geometry which connects said inlet and outlet with one another, said suction pipe further being provided with a pressure-relieving site for relieving pressure waves emanating from the outlet, said pressure-relieving site comprising a bursting geometry in a wall section of the suction pipe, and a buffer volume adjoining said bursting geometry;

wherein said bursting geometry comprises a lid installed in an associated opening in said wall section of the suction pipe and said lid having a conical geometry which tapers toward the interior of the suction pipe.

17. A suction pipe for intake air of an internal combustion engine, said suction pipe connecting an intake air inlet and at least one intake air outlet leading to a cylinder of the engine, said suction pipe having an interior surface defining an air-guiding geometry which connects said inlet and outlet with one another, said suction pipe further being provided with a pressure-relieving site for relieving pressure waves emanating from the outlet, said pressure-relieving site comprising a bursting geometry in a wall section of the suction pipe, and a buffer volume adjoining said bursting geometry;

wherein said bursting geometry is formed by a weakening in said wall section relative to surrounding wall portions of the suction pipe.

18. A suction pipe according to claim 17, wherein said weakening is comprised of a groove which forms a fracture boundary around said wall section.

19. A suction pipe according to claim 18, wherein said groove is formed in said wall section on a side remote from the interior surface of the suction pipe which defines the air-guiding geometry.

20. A suction pipe for intake air of an internal combustion engine, said suction pipe connecting an intake air inlet and at least one intake air outlet leading to a cylinder of the engine, said suction pipe having an interior surface defining an air-guiding geometry which connects said inlet and outlet with one another, said suction pipe further being provided with a pressure-relieving site for relieving pressure waves emanating from the outlet, said pressure-relieving site comprising a bursting geometry in a wall section of the suction pipe, and a buffer volume adjoining said bursting geometry;

wherein said bursting geometry is defined by a groove which is formed in said wall section on a side remote from the interior surface of the suction pipe which defines the airguiding geometry.

21. A suction pipe for intake air of an internal combustion engine, said suction pipe connecting an intake air inlet and at least one intake air outlet leading to a cylinder of the engine, said suction pipe having an interior surface defining an air-guiding geometry which connects said inlet and outlet with one another, said suction pipe further being provided with a pressure-relieving site for relieving pressure waves emanating from the outlet, said pressure-relieving site comprising a bursting geometry in a wall section of the suction pipe, and a buffer volume adjoining said bursting geometry;

wherein at least one buckling groove is provided on said wall section.

* * * * *